US007748759B2

(12) United States Patent
Chen et al.

(10) Patent No.: US 7,748,759 B2
(45) Date of Patent: Jul. 6, 2010

(54) DOOR LOCK HAVING AN UNLOCKING MECHANISM FOR SIMULTANEOUSLY UNLATCHING LATCH-BOLT AND DEADBOLT MECHANISMS

(75) Inventors: Po-Yang Chen, Chia-Yi (TW); Lan-Kun Don, Chia-Yi (TW)

(73) Assignee: Tong-Lung Metal Industry Co., Ltd., Chia-Yi (TW)

( * ) Notice: Subject to any disclaimer, the term of this patent is extended or adjusted under 35 U.S.C. 154(b) by 302 days.

(21) Appl. No.: 11/763,596

(22) Filed: Jun. 15, 2007

(65) Prior Publication Data

US 2008/0001414 A1 Jan. 3, 2008

(30) Foreign Application Priority Data

Jun. 16, 2006 (TW) ..... 95210628 U

(51) Int. Cl.
*E05B 1/00* (2006.01)

(52) U.S. Cl. ..... 292/347; 292/39; 292/DIG. 60; 292/DIG. 64; 292/244

(58) Field of Classification Search ..... 292/347, 292/39, DIG. 60, DIG. 64, 244; 70/224
See application file for complete search history.

(56) References Cited

U.S. PATENT DOCUMENTS

| | | | | | |
|---|---|---|---|---|---|
| 3,910,613 | A | * | 10/1975 | Nolin | 292/34 |
| 3,999,789 | A | * | 12/1976 | Maurits et al. | 292/34 |
| 4,129,019 | A | | 12/1978 | Urdal | |
| 4,725,085 | A | * | 2/1988 | Hu et al. | 292/172 |
| 4,979,767 | A | * | 12/1990 | Lin | 292/336.3 |
| 5,657,653 | A | * | 8/1997 | Hensley et al. | 70/224 |
| 6,058,746 | A | * | 5/2000 | Mirshafiee et al. | 70/107 |
| 6,128,933 | A | * | 10/2000 | Mirshafiee et al. | 70/107 |

* cited by examiner

*Primary Examiner*—Carlos Lugo
*Assistant Examiner*—Mark Williams
(74) *Attorney, Agent, or Firm*—Chun-Ming Shih

(57) ABSTRACT

A door lock includes upper and lower cam mechanisms mounted on an inner support plate, and a slide plate disposed between the upper and lower cam mechanism. The upper cam mechanism includes a spindle, and an upper cam body mounted on the spindle and having a tab projecting from the upper cam body. The upper cam body is rotatable relative to the spindle to change the tab between a left-hand installation configuration for a left-hand door installation and a right-hand installation configuration for a right-hand door installation. The slide plate has two opposite marginal portions extending respectively into slide passages provided on the inner support plate.

6 Claims, 14 Drawing Sheets

DOOR LOCK HAVING AN UNLOCKING MECHANISM FOR SIMULTANEOUSLY UNLATCHING LATCH-BOLT AND DEADBOLT MECHANISMS

CROSS-REFERENCE TO RELATED APPLICATION

This application claims priority of Taiwanese Application No. 095210628, filed on Jun. 16, 2006.

BACKGROUND OF THE INVENTION

1. Field of the Invention

The invention relates to a door lock, more particularly a door lock including an unlocking mechanism that can be operated through an inner latch bolt operator to unlatch a latch bolt mechanism and a deadbolt mechanism simultaneously.

2. Description of the Related Art

To permit a panic exit, it is known to provide a door lock with an unlocking mechanism that can be operated through a latch bolt operator at the inside of a door to unlatch a deadbolt simultaneously with the latch bolt Door locks of the above-mentioned type have existed in various forms. An example of such door locks is disclosed in Taiwanese Utility Model Application No. 88204254 and is shown in FIGS. 1, 2 and 3.

Referring to FIGS. 1-3, a door lock is shown to include a slide plate (A) mounted on an inner support plate (B) and having an upper push member (A1) and a lower push member (A2). When the lower cam (D) is rotated by turning an inner latch operator (E) from a position shown in FIG. 2 to another position shown in FIG. 3 to retract a latch bolt (not shown), the lower push member (A2) is moved upward by the lower cam (D) so that the upper push member (A1) drives an upper cam (F) to turn upward or clockwise for unlatching or retracting a deadbolt (not shown). However, although the upper cam (F) turns from a horizontally lying position shown in FIG. 2 to a vertically extending position shown in FIG. 3 when the inner latch operator (E) is operated, because clearances inevitably exist at the connections between components, it is difficult for the upper cam (F) to turn by an angle equal to or larger than 90 degrees. When the turning angle of the upper cam (F) is smaller than 90 degrees, the deadbolt cannot be retracted completely or sufficiently.

U.S. Pat. No. 4,129,019 discloses a door lock of similar type which also includes a slide plate and upper and lower cams all of which are assembled on two cartridge plates to form a cartridge. While the upper cam therein is turnable by 90 degrees or more, a disadvantage therein is that the door lock cannot be changed conveniently between a configuration for a left-hand door installation and a configuration for a right-hand door installation because the entire cartridge must be detached from a place where it is attached and must be turned inside out for configurational changes.

SUMMARY OF THE INVENTION

Therefore, the main object of the present invention is to provide a door lock of the aforementioned type which can solve the problem due to the turning angle of an upper cam mechanism smaller than 90 degrees and which can be changed conveniently between a left-hand installation configuration and a right-hand installation configuration.

According to the present invention, an unlocking mechanism for a door lock that can be applied to a left-hand door or a right-hand door comprises upper and lower cam mechanisms, and a slide plate disposed between the upper and lower cam mechanisms and driven by the lower cam mechanism to drive the upper cam mechanism. The upper cam mechanism includes a spindle, and an upper cam body mounted on the spindle and having a tab projecting from the upper cam body to be rotated by the slide plate the upper cam body is rotatable relative to the spindle to change the tab between a left-hand installation configuration for a left-hand door installation and a right-hand installation configuration for a right-hand door installation.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
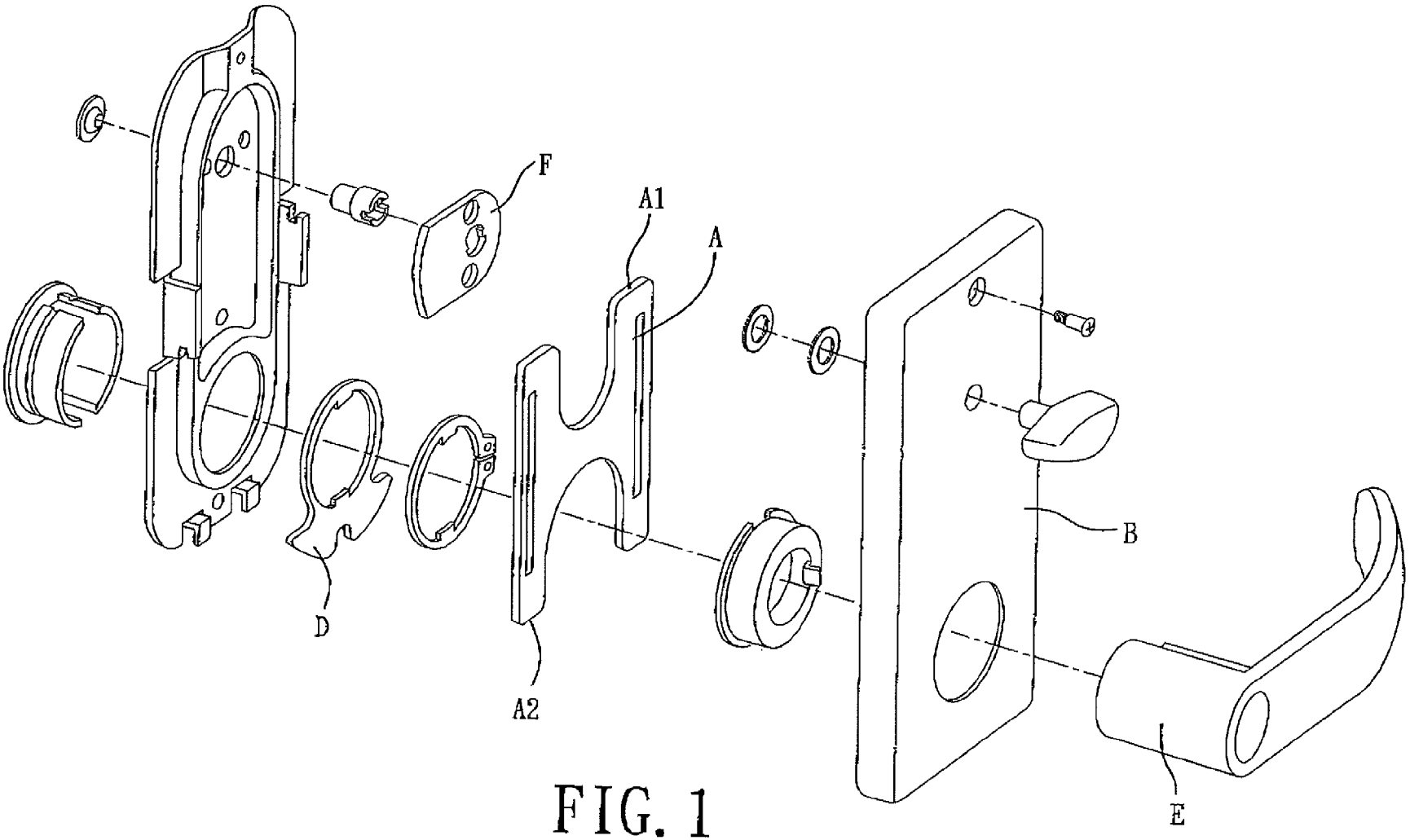
FIG. 1 PRIOR ART
FIGS. 1-3 shows a conventional door lock disclosed in Taiwanese Utility Model Application No. 88204254.
Figure 3:
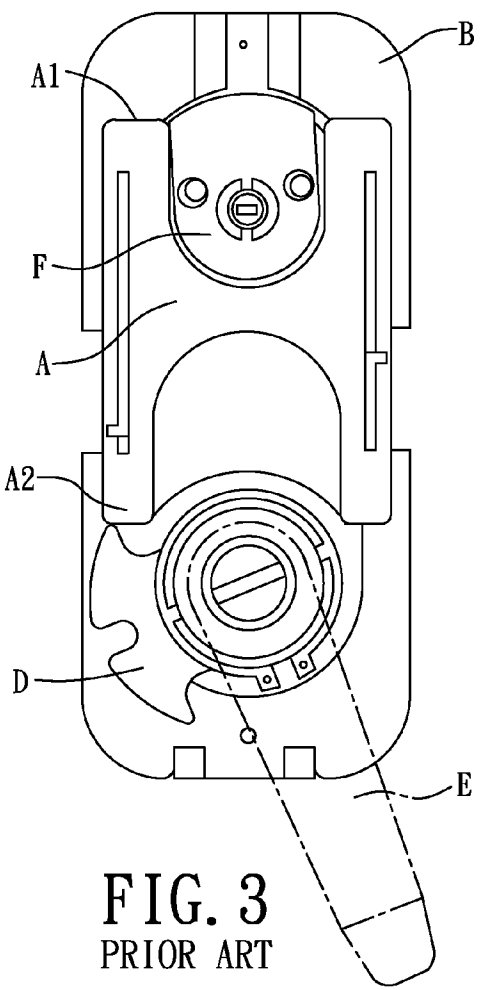
FIG. 3 PRIOR ART
Figure 2:
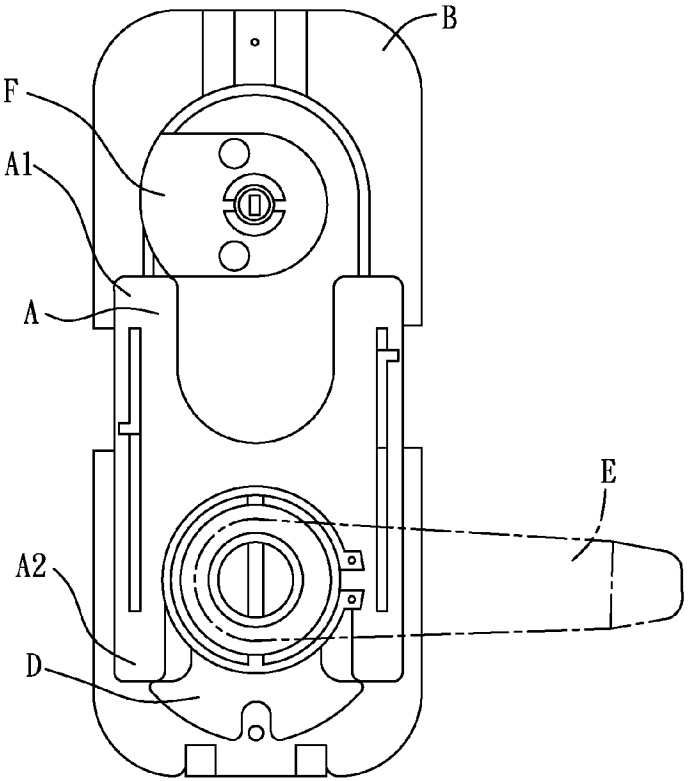
FIG. 2 PRIOR ART

Before the present invention is described in greater detail, it should be noted that like elements are denoted by the same reference numerals throughout the disclosure.

Figure 4:
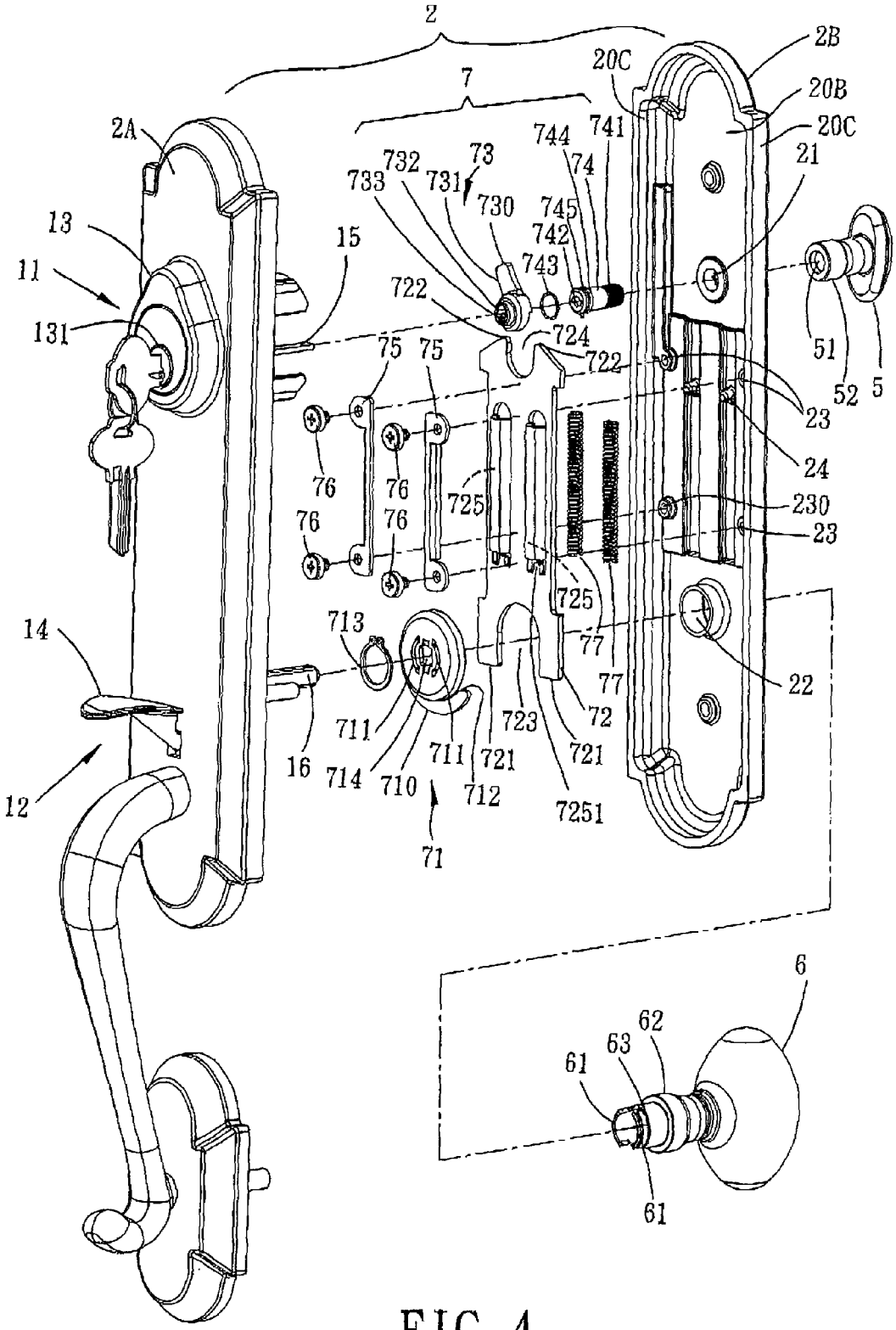
FIG. 4 is an exploded view of a door lock according to the present invention.
Figure 5:
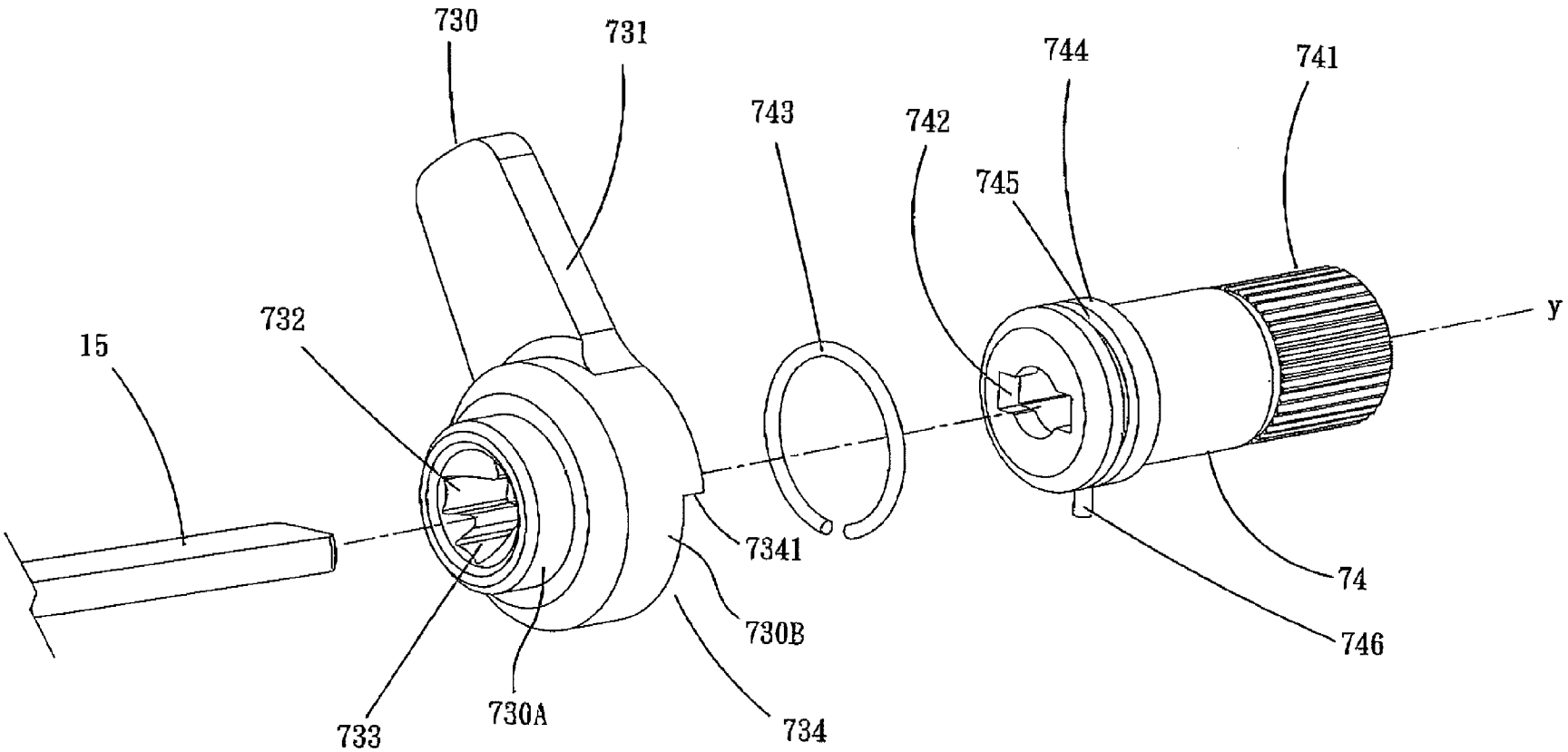
FIG. 5 is an exploded view of an upper cam mechanism of the door lock of FIG. 4.
Figure 6:
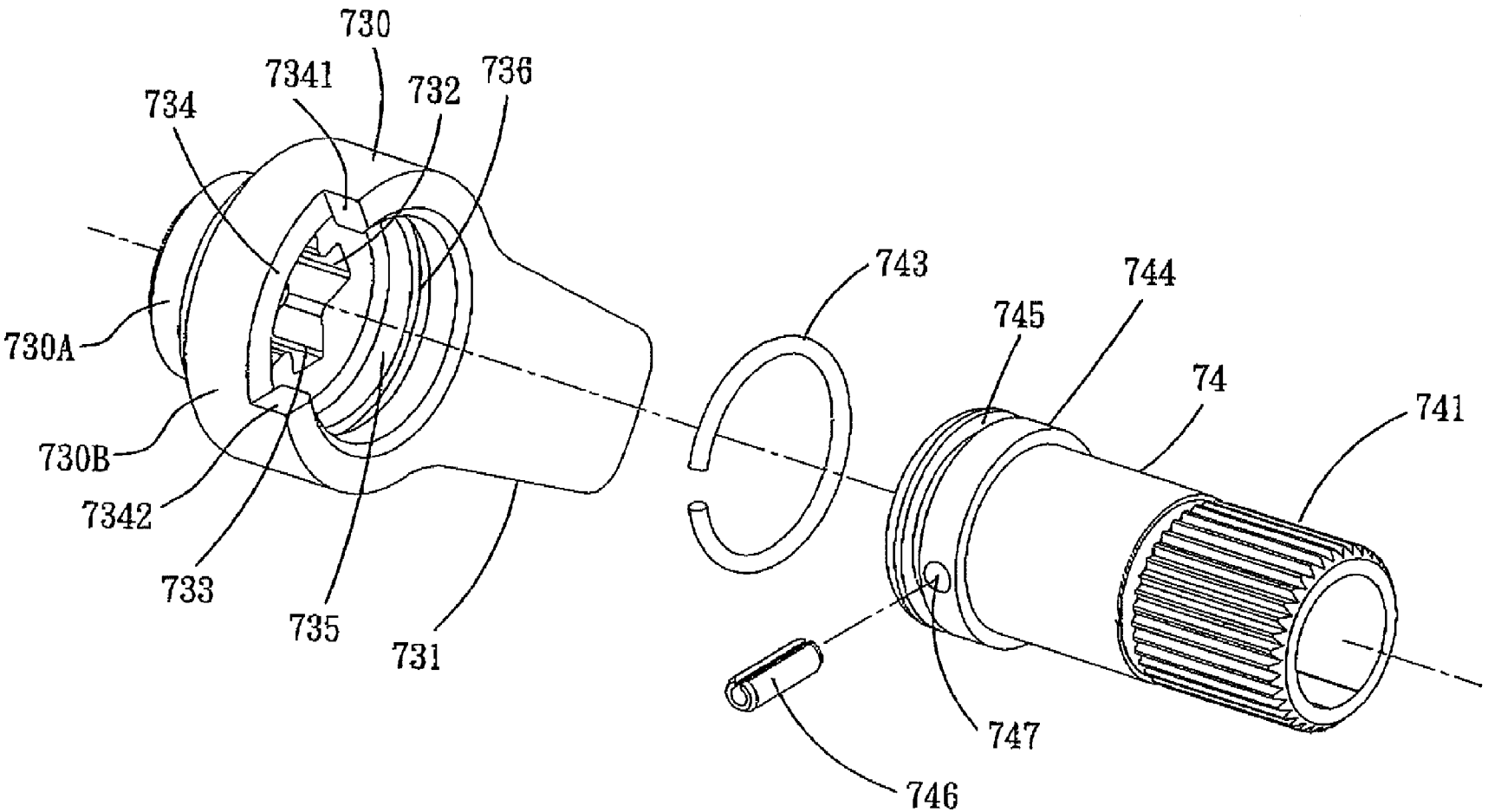
FIG. 6 is another exploded view of the upper cam mechanism of the door lock of FIG. 4.
Figure 7:
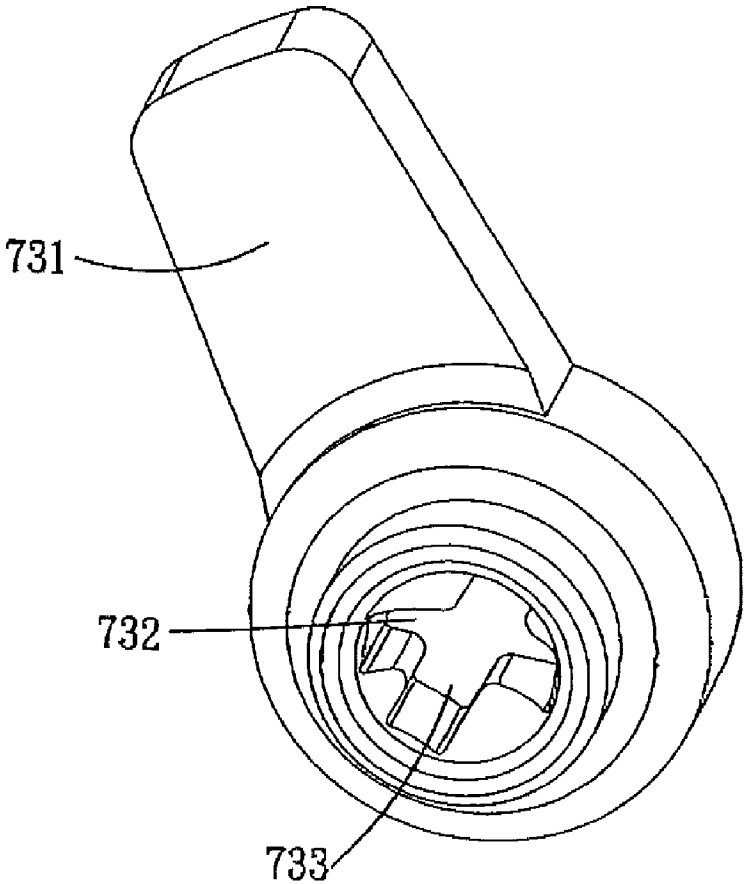
FIG. 7 is a perspective view of an upper cam body of the upper cam mechanism.

Referring to FIGS. 4, 5 and 6, a door lock embodying the present invention includes a support 2, an unlocking mechanism 7, a key-operated lock unit 11 mounted on an outer support plate 2A of the support 2, and an outer latch bolt operator 12 mounted on the outer support plate 2A. The key-operated lock unit 11 has a key-operated lock body 13 with a key plug 131 connected to a drive spindle 15 that in turn is connected to a deadbolt mechanism (not shown). An inner deadbolt operator 5 is mounted on an inner support plate 23 of the support 2 and is connected to the drive spindle 15. When the inner deadbolt operator 5 is rotated, the deadbolt mechanism can be retracted or unlatched. The outer latch bolt operator 12 has a lock lever 14 connected to a spindle tube 16 that in turn is connected to a latch bolt mechanism (not shown). An inner latch bolt operator 6 is connected to the spindle tube 16 of the outer latch bolt operator 12.

The unlocking mechanism 7 has a lower cam mechanism 71, a slide plate 72, and an upper cam mechanism 73. The lower cam mechanism 71 has a lower cam body 710. The upper cam mechanism 73 has an upper cam body 730, and a spindle 74.

The inner latch bolt operator 6 includes a shaft portion 62 which has an end provided with an annular indentation 63 and two ear members 61. The ear members 61 extend through a hole 22 in the inner support plate 2B and respective holes 711 in the lower cam body 710. A locking ring 713 is fitted in the annular indentation 63 of the shaft portion 62 so that the inner latch bolt operator 6 is connected to the lower cam mechanism 71 for simultaneous rotation therewith. The lower cam body 710 has a central hole 714 connected to the spindle tube 16 of the outer latch bolt operator 12.

The inner support plate 2B has a base wall 20B, and two opposite side walls 20C projecting from the base wall 20B and extending in a top-to-bottom direction. Spacers 23 protrude from the base wall 20B and are proximate to the side walls 20C. Two guide members in the form of elongate plates 75 are fixed to the spacers 23 by means of screws 76 and screw holes 230 in the spacers 23 so that the guide members or elongate plates 75 are spaced apart from the base wall 20B, and define slide passages (not shown) with the base wall 20B, which are proximate to the side walls 20C, respectively.

Figure 10:
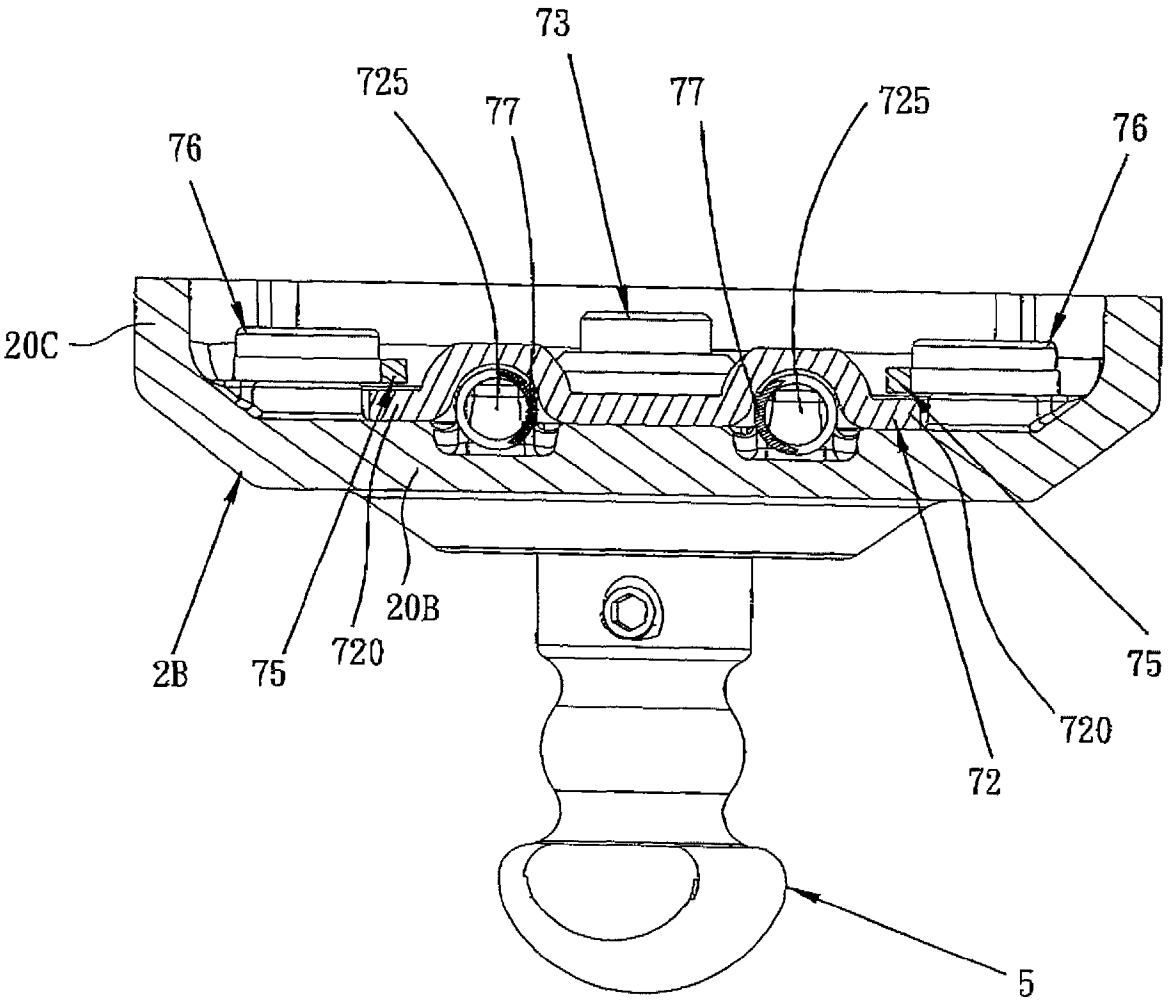
FIG. 10 is a sectional view taken along line 10-10 of FIG. 9.

The slide plate 72 is disposed slidably on the base wall 20B between the side walls 20C and has two opposite marginal portions 720 (see FIG. 10) respectively extending into the slide passages each defined between the base plate 20B and one of the guide member or elongate plates 75. The slide plate 72 further has two opposite upper flanges 7201 (see FIG. 8) that are in sliding contact with ribs 231 formed on the base wall 20B. Two positioning grooves 72S are provided in the slide plate 72 between the marginal portions 720, extend along a sliding direction of the slide plate 72, and receive biasing members 77, respectively. The biasing members 77 are in the form of compression springs each of which has a top end engaged with a stud 24 projecting from the base wall 20B and a bottom end engaged with an upward tang 7251 (FIG. 4) projecting into the respective positioning groove 725 so that the slide plate 72 is biased to move downward toward the lower cam mechanism 71.

The slide plate 72 further has a top end provided with an upper recess 724 to receive the upper cam body 730 when the slide plate 72 moves upward, and left and right upper push members 722 at left and right sides of the upper recess 724. The slide plate 72 further has a bottom end formed with a lower recess 723 to receive the shaft portion 62 of the inner latch bolt operator 6, and left and right lower push members 721 at left and right sides of the lower recess 723.

The inner deadbolt operator 5 has a shaft portion 52 with an axial hole 51. The spindle 74 of the upper cam mechanism 73 has an annulary toothed portion 741 extending through a hole 21 in the inner support plate 2B and is inserted into the axial hole 51 of the shaft portion 52. The spindle 74 further has a cam-holding portion 744 provided with a spindle slot 742, an annular recess 745, and a resilient ring 743 fitted in the annular recess 745.

The upper cam body 730 has a sleeve portion 730B sleeved rotatably around the cam-holding portion 744 of the spindle 74, and a head portion 730A extending from the sleeve portion 730B in a direction away from the spindle 74. The sleeve portion 730B has a tubular inner surface 735 in sliding contact with the cam-holding portion 744, an annular groove 736 formed in the inner surface 735, and a notch 734 that is elongated in an angular direction. When the sleeve portion 730B is sleeved onto the cam-holding portion 744 of the spindle 74, the annular groove 736 engages the resilient ring 743 fitted in the annular recess 745 of the cam-holding portion 744, thereby preventing the upper cam body 730 from being released from the spindle 74.

The head portion 730A has a tab 731 projecting radially from the head portion 730A to be pushed by the upper push member 722 of the slide plate 72, and first and second cam slots 732, 733 extending through the head portion 730A. The first and second cam slots 732, 733 have oblong cross sections and intersect each other at a center line (Y) of the spindle 74.

The upper cam body 730 is rotatable relative to the spindle 74 to enable the tab 731 to change between a left-hand installation configuration for a left-hand door installation of the door lock and a right-hand installation configuration for a right-hand door installation of the door lock. The upper cam mechanism 73 further includes an engagement unit to interengage the upper cam body 730 and the spindle 74 for simultaneous rotation when the tab 731 is in the left-hand or right-hand installation configuration. In this embodiment, the engagement unit has first and second engaging members which are respectively defined by angularly spaced apart first and second notch edges 7342, 7341 that bound the notch 734 in the sleeve portion 730B of the upper cam body 730. The cam-holding portion 744 of the spindle 74 has a pin 746 projecting radially and outwardly from the cam-holding portion 744 and into the notch 734. The pin 746 may be a hollow pin of substantially C-shaped cross section that is formed by rolling a metal plate and that is fitted in a radial hole 747 in the cam-holding portion 744. Alternatively, the pin 746 may be a solid pin fitted in the radial hole 747, or a solid or hollow pin formed integrally with the cam-holding portion 744.

Figure 8:
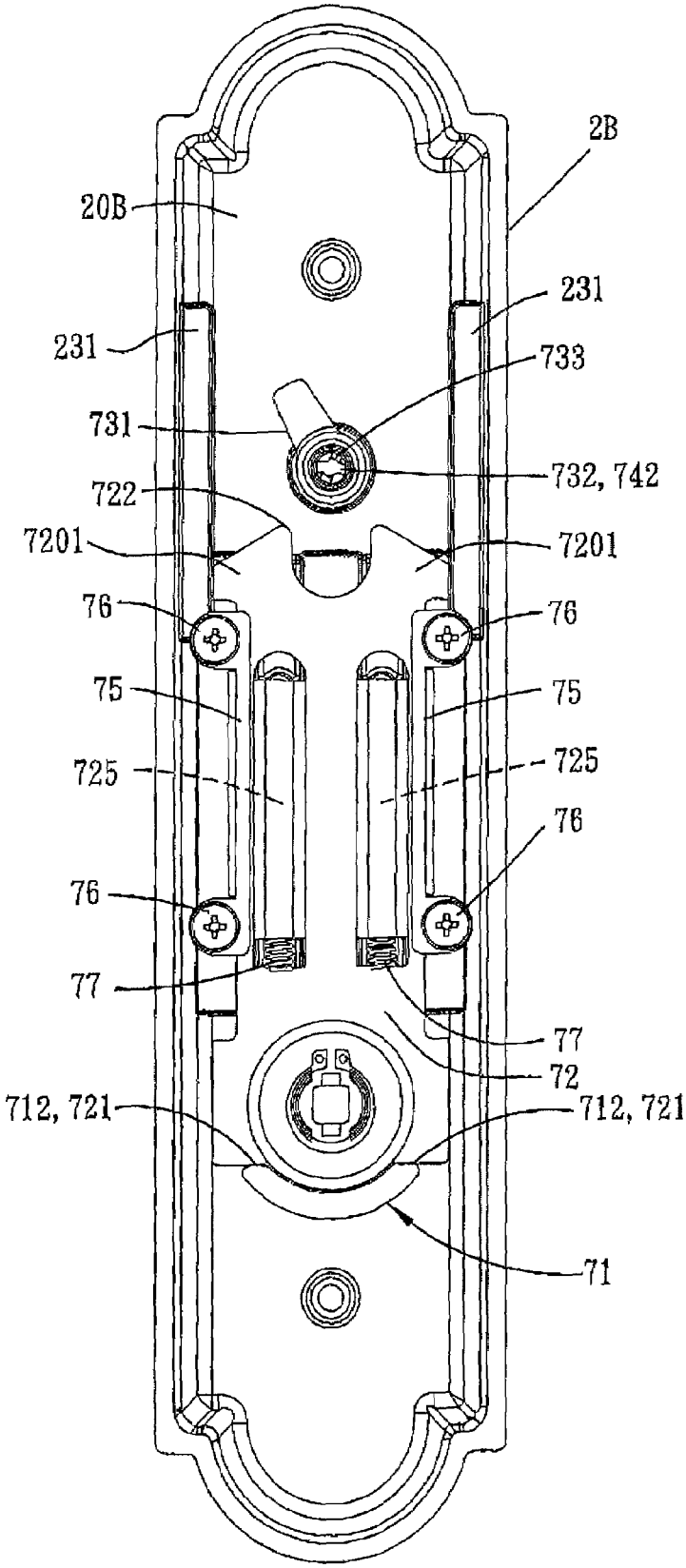
FIG. 8 shows a right-hand installation configuration of the upper cam mechanism.
Figure 9:
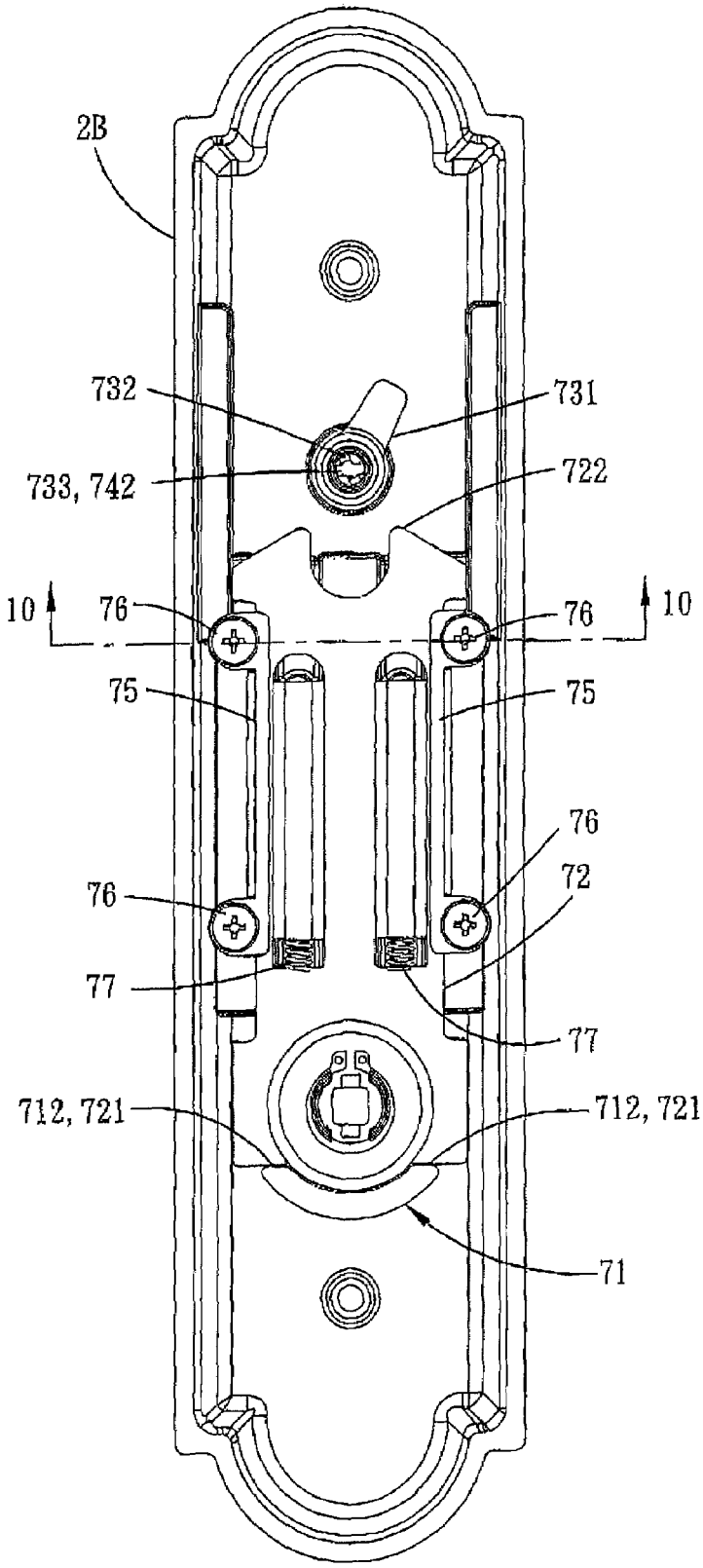
FIG. 9 shows a left-hand installation configuration of the upper cam mechanism.

Referring to FIG. 8 in combination with FIGS. 5 and 6, when the spindle 74 is rotated to engage the first engaging member or notch edge 7342 with the pin 746 of the spindle 74, the tab 731 is in the right-hand installation configuration, the first cam slot 732 is aligned with the spindle slot 742, and the drive spindle 15 of the key-operated lock unit 11 extends into the first cam slot 732 and the spindle slot 742 when the spindle 74 is rotated to engage the second engaging member or notch edge 7341 with the pin 746, the tab 731 is in the left-hand installation configuration as shown in FIG. 9, the second cam slot 733 is aligned with the spindle slot 742, and the drive spindle 15 extends into the second cam slot 733 and the spindle slot 742.

Figure 11:
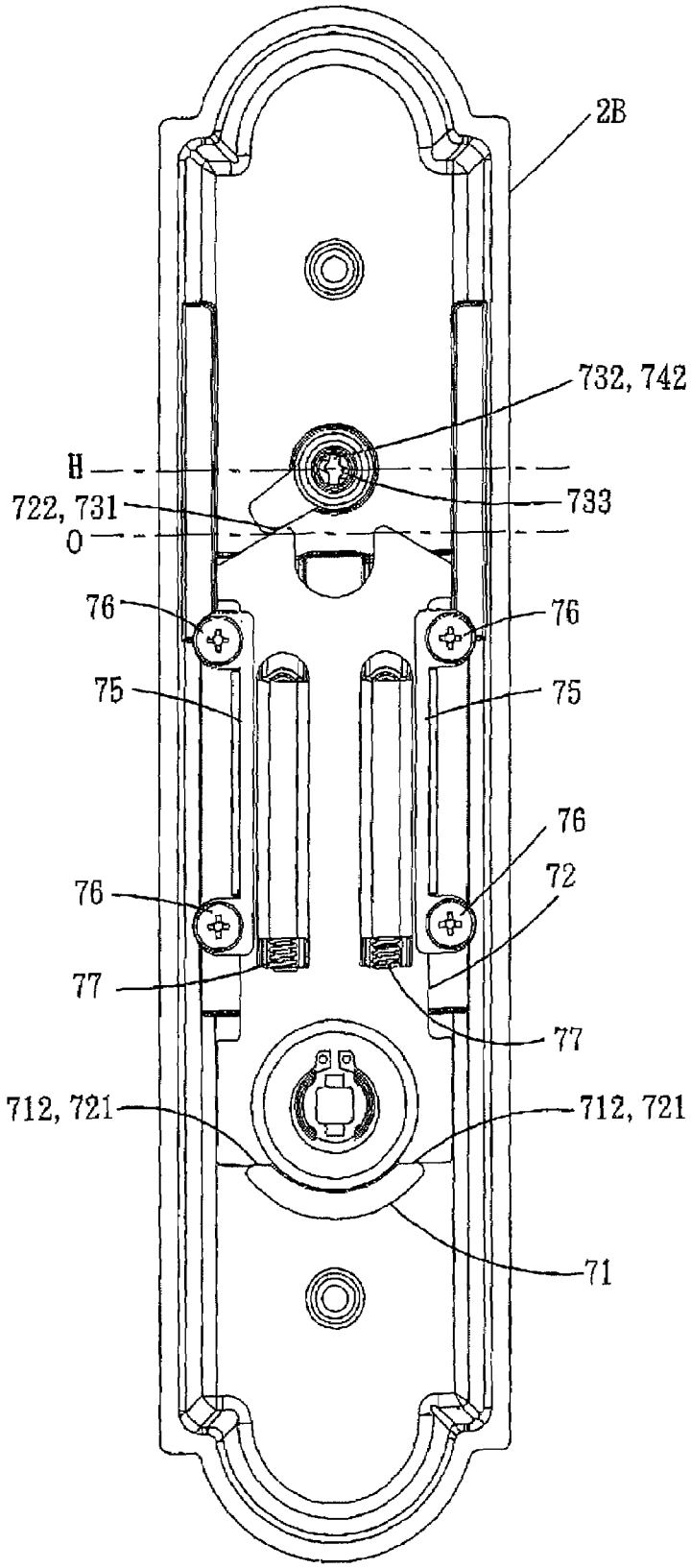
FIGS. 11 and 12 show an operation of the right-hand installation configuration.
Figure 12:
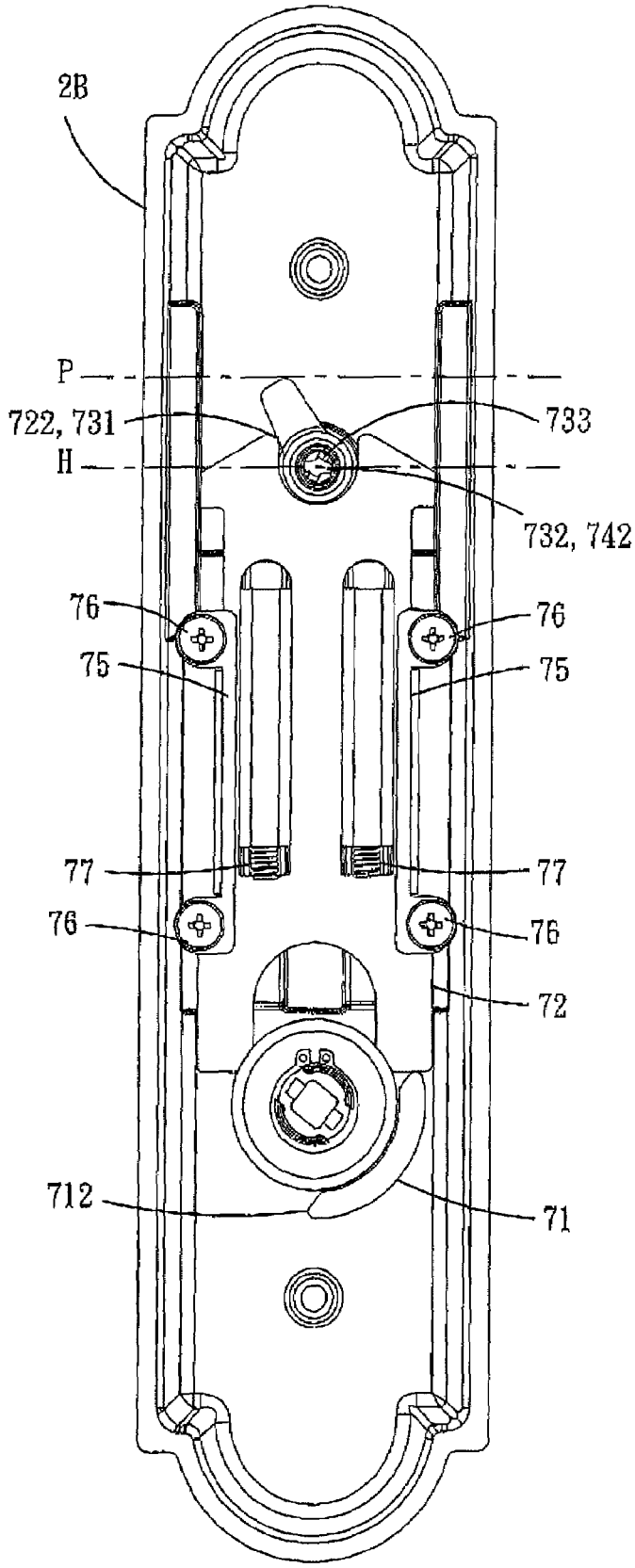

Referring to FIG. 11 in combination with FIG. 4, when the tab 731 is in the right-hand installation configuration and before the slide plate 72 is pushed by the lower cam mechanism 71, a distal end of the tab 731 extends to a level (O) lower than a horizontal line (R) passing through a center line (Y) (see FIG. 5) of the spindle 74. When the inner latch bolt operator 6 is rotated, one of two push ends 712 of the lower cam mechanism 71 pushes one of the lower push members 721 of the slide plate 72 so that the slide plate 72 moves upward and the upper push member 722 thereof pushes the tab 731 to turn upward to a level (P) higher than the horizontal line (H) as shown in FIG. 12, thereby unlatching the latch bolt mechanism (not shown) and the deadbolt mechanism (not shown) simultaneously. When the inner latch bolt operator 6 is not rotated, the slide plate 72 moves downward to its original position by the action of the springs 77.

Note that the tab 731 can rotate by an angle larger than 90 degrees when turning from the level (O) to the level (P) so that the deadbolt mechanism (not shown) can be retracted assuredly into a door panel for unlatching. Thus, the incidence of incomplete or insufficient unlatching or retracting of the deadbolt mechanism can be eliminated.

Figure 13:
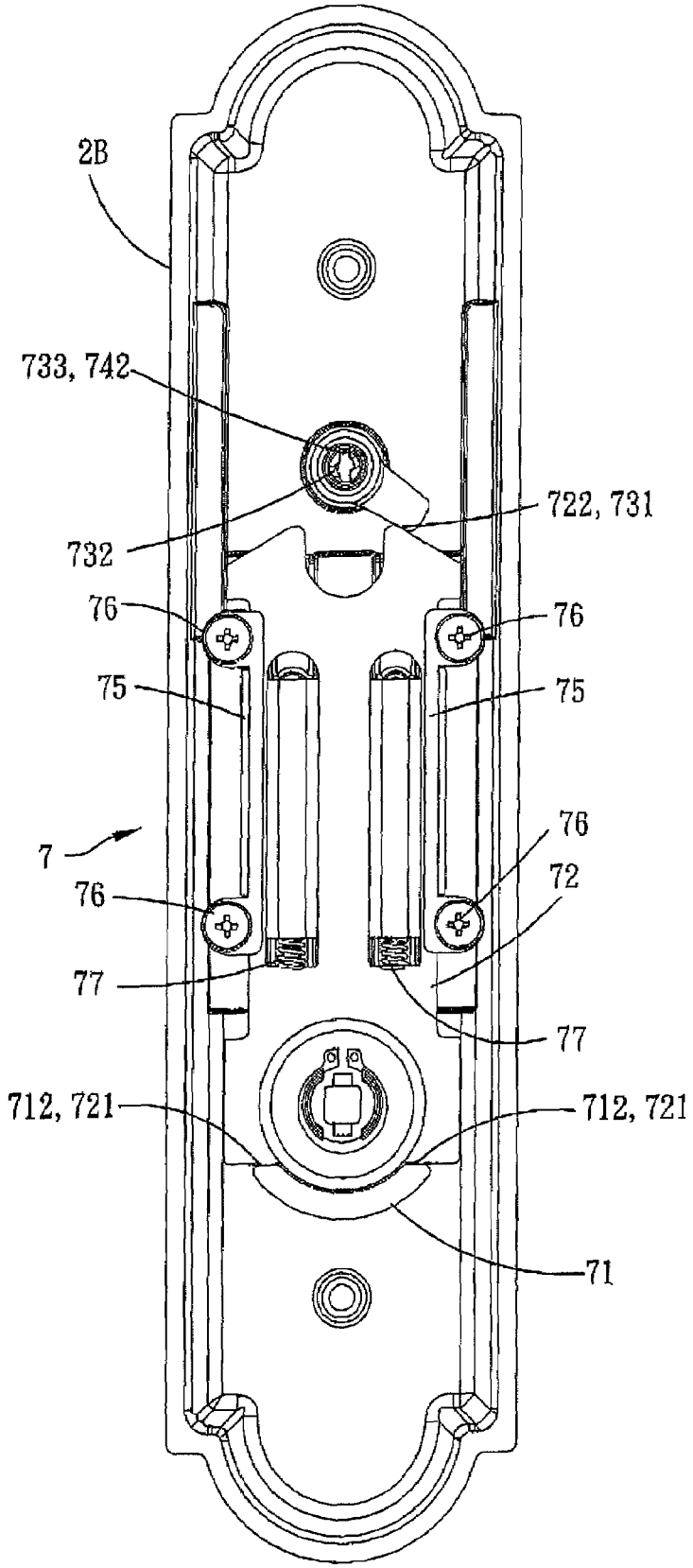
FIGS. 13 and 14 show an operation of the left-hand installation configuration.
Figure 14:
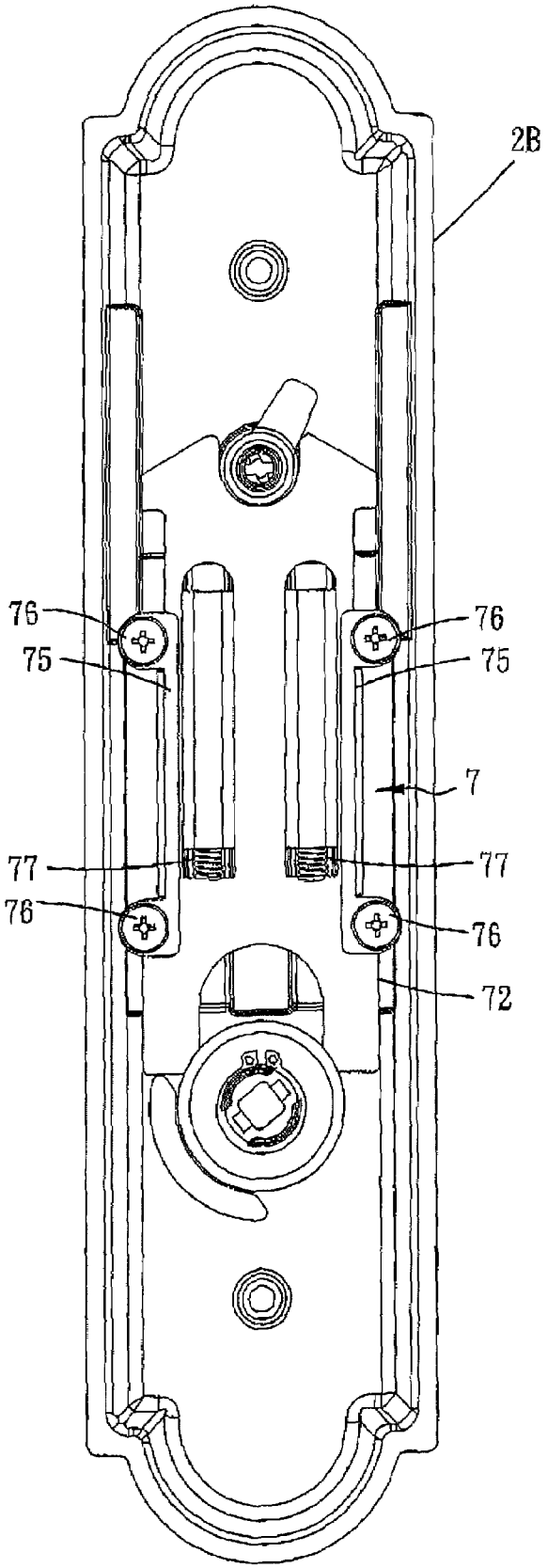

FIGS. 13 and 14 show the operation of the unlocking mechanism 7 when the tab 731 is in the left-hand installation configuration.

Figure 15:
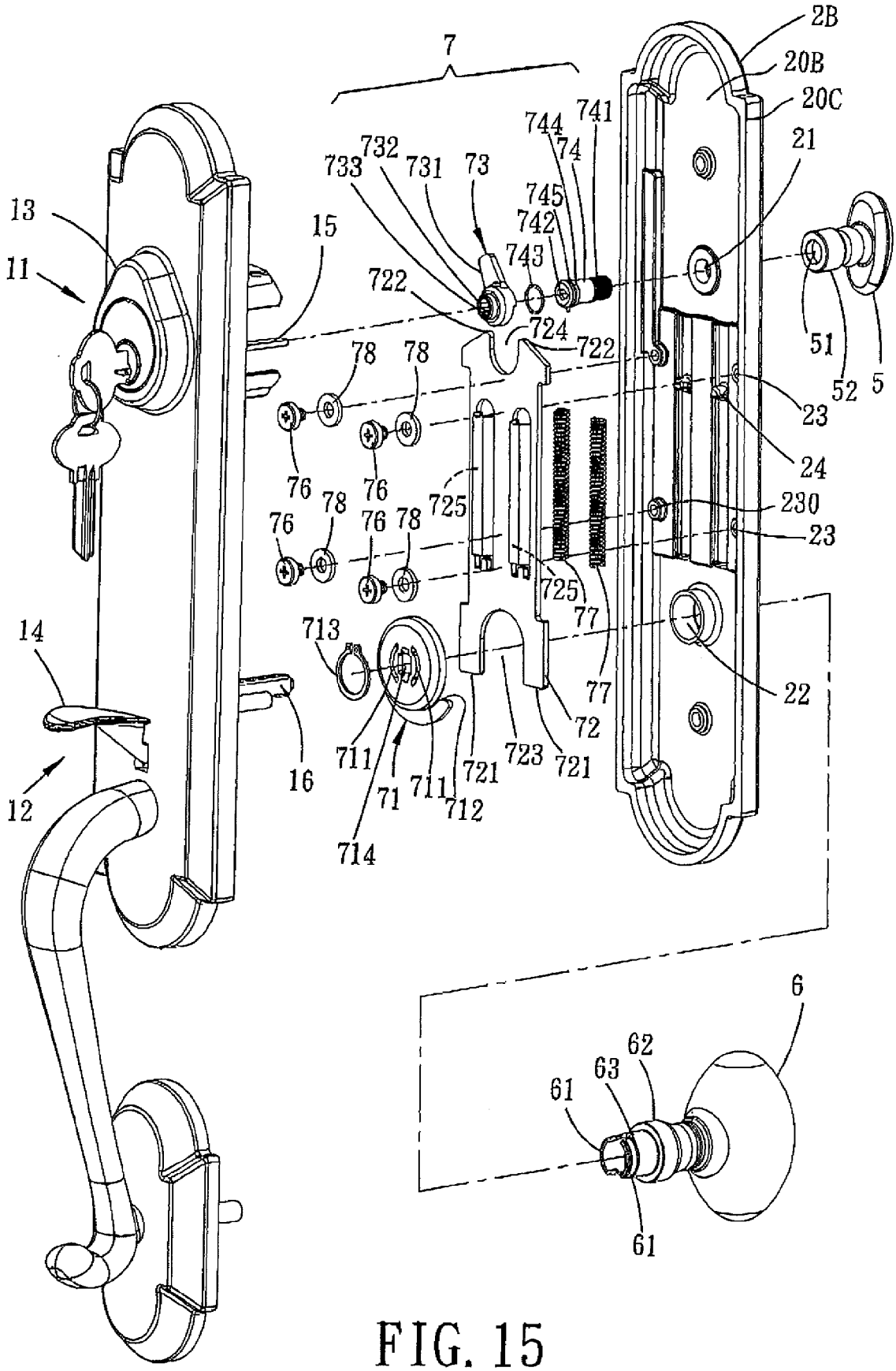
FIG. 15 shows an alternative arrangement for mounting a slide plate of the door lock of FIG. 4.

Referring to FIG. 15, there is shown an alternative arrangement for mounting slidably the slide plate 72 on the inner support plate 2B, in which packing rings 78 are used as guide members in place of the elongate plates 75, and are respectively fixed to the spacers 23 on the base wall 208 by means of screws 76. Each of the two opposite marginal portions 720 (see FIG. 10) of the slide plate 72 extends between the base wall 20B and the packing rings 78 proximate to one of the side walls 20C.

Alternatively, each packing ring 78 may be formed integrally with the respective screw 76 to have a unitary structure.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. An unlocking mechanism for a door lock that can be applied to a left-hand door or a right-hand door, comprising:

upper and lower cam mechanisms;

a slide plate disposed between said upper and lower cam mechanisms and driven by said lower cam mechanism to drive said upper cam mechanism;

said upper cam mechanism including a spindle, and an upper cam body mounted on said spindle and having a tab projecting from said upper cam body to be rotated by said slide plate, said upper cam body being rotatable relative to said spindle to change said tab between a left-hand installation configuration for a left-hand door installation and a right-hand installation configuration for a right-hand door installation;

said upper cam mechanism including an engagement unit to interengage said upper cam body and said spindle for simultaneous rotation when said tab is in said left-hand, or right-hand installation configuration;

said engagement unit including a first and a second engaging members provided on said upper cam body to engage said spindle, one of said first and said second engaging members engaging said spindle when said tab is in one of said left-hand and right-hand installation configurations;

said spindle having a cam-holding portion, said upper cam body further having a sleeve portion sleeved rotatably around said cam-holding portion and having a notch, and two angularly spaced apart notch edges bounding said notch and defining said first and second engaging members, respectively; and said cam-holding portion haying a pin projecting radially and outwardly from said cam-holding portion and into said notch to engage one of said first and second engaging members.

2. The unlocking mechanism of claim 1, wherein said sleeve portion has an inner surface in sliding contact with said cam-holding portion, an annular groove formed in said inner surface, and a resilient ring fitted in said annular groove, said cam-holding portion having an outer surface formed with an annular recess engaging said resilient ring.

3. The unlocking mechanism of claim 1, wherein said upper cam body further has first and second cam slots adapted to be used selectively for engagement with a drive spindle of a key-operated lock unit of the door lock, said first and second cam slots having oblong cross sections and intersecting each other at a center line of said spindle.

4. The unlocking mechanism of claim 3, wherein said spindle has a spindle slot, said first cam slot being aligned with said spindle slot when said tab is in one of said left-hand and right-hand installation configurations, said second cam slot being aligned with said spindle slot when said tab is in the other one of said left-hand and right-hand installation configurations.

5. The unlocking mechanism of claim 3 wherein a head portion extending from said sleeve portion in a direction away from said spindle has said first and second cam slots.

6. The unlocking mechanism of claim 1, wherein said tab projects radially from said upper cam body and is rotatable about a center line of said spindle, said tab having a distal end extending to a level lower than a horizontal line passing through said center line before being moved by said slide plate, said distal end turning upward to a level higher than said horizontal line after being moved by said slide plate.

* * * * *